US005296324A

United States Patent [19]

Akagi et al.

[11] Patent Number: 5,296,324

[45] Date of Patent: Mar. 22, 1994

[54] TONER FOR DEVELOPING ELECTROSTATIC CHARGE IMAGE AND PROCESS FOR PREPARING THE SAME

[75] Inventors: Hideyuki Akagi; Susumu Saito; Masaru Miura; Takashi Imai; Masayuki Takei; Masanori Ichimura; Michio Take; Satoshi Inoue; Yasuo Yamamoto; Toshiaki Murofushi; Hiroshi Nakazawa; Koji Fukushima, all of Minami-ashigara, Japan

[73] Assignee: Fuji Xerox Co., Ltd., Tokyo, Japan

[21] Appl. No.: 877,733

[22] Filed: May 4, 1992

[30] Foreign Application Priority Data

May 14, 1991 [JP] Japan ..... 3-137041
May 14, 1991 [JP] Japan ..... 3-137043

[51] Int. Cl.[5] ..... G03G 9/08
[52] U.S. Cl. ..... 430/106; 430/111
[58] Field of Search ..... 430/106, 109, 110, 111

[56] References Cited

U.S. PATENT DOCUMENTS 5,066,558 11/1991 Hikake et al. ..... 430/109
5,077,170 12/1991 Tsujihiro ..... 430/109

FOREIGN PATENT DOCUMENTS 2-151872 6/1990 Japan .

*Primary Examiner*—John Goodrow
*Attorney, Agent, or Firm*—Oliff & Berridge

[57] ABSTRACT

A toner for developing an electrostatic charge image is disclosed, which is formed by adding and mixing an external additive with toner particles having an average particle size of not larger than 9 μm and comprising at least a colorant and a binder resin, wherein the external additive is fine particles having a particle size of 20 to 80 nm. There is also disclosed a process for preparing the toner which comprises adding external additives to the toner particles and mixing them, wherein the addition and mixing of said external additive are carried out under specific conditions.

11 Claims, 3 Drawing Sheets

TONER FOR DEVELOPING ELECTROSTATIC CHARGE IMAGE AND PROCESS FOR PREPARING THE SAME

FIELD OF THE INVENTION

This invention relates to a toner for developing an electrostatic charge image. It also relates to a process for preparing the same.

BACKGROUND OF THE INVENTION

Small-size toners having a particle size of not larger than 9 μm have been used in recent years to provide an image of higher quality. An image of higher quality can be provided by making toner particles finer, but there are caused problems that transferability (i.e., transferring property) and cleaning properties are lowered. To solve these problems, various additives such as transfer aid and cleaning aid have been added to the toner particles. For example, an attempt to improve the powder fluidity of toners has been made by adding fine silica particles to thereby improve transferability, or an attempt to improve cleaning properties has been made by adding lubricants or polymer beads.

These problems can also be improved by lowering the chargeability (i.e., tribocharge) of the toner. In this case, however, there is posed a problem that the occurrence of toner cloud is marked and a trouble due to contamination in machines is caused. FIG. I-1 and FIG. I-2 illustrate these phenomenons. FIG. I-1 is a graph illustrating the relationship between the charge quantity of a toner and adhesion (i.e., adhesive power). FIG. I-2 is a graph illustrating the relationship between the charge quantity of a toner and a toner-peeling electric field (an electric field required for peeling off the toner). It can be seen from these figures that in the case where the charge quantities of the toners are the same, the adhesion of the toner is independent of particle size, while the electric field for peeling off the toner is greatly increased with a reduction in the particle size of the toner. This means that the latitude of transfer cloud becomes greatly narrow by making the particle size of the toner finer.

When external additives are conventionally added to and mixed with the toners, the toners themselves have a particle size of as large as 10 μm or more and hence transferability is good. Accordingly, only a fluidizing agent conventionally is added to and mixed with the toners. In those toner compositions, the fluidizing agent is mixed so as to allow it to firmly adhere to the toners. The addition of two types of external additives having a particle size of not larger than 30 μm to toner particles having an average particle size of 12 μm has been proposed to increase the charge quantity and at the same time to improve transferability as disclosed in JP-A-2-151872 (the term "JP-A" as used herein means an "unexamined published Japanese patent application"). In such a toner composition, the external additives are mixed under such conditions that the additives are allowed to firmly adhere to the toner particles. In carrying out transfer, the particle size of toner greatly contributes to transferability and a contact area between a photoreceptor and the toner is small so that transfer can be relatively well-made irrespective of the mixing conditions.

However, when small-size toners are used, the charge quantity per gram is increased and transferability is lowered. Hence, the particle sizes of the additive particles should be large and as a result, there is a problem that good transferability can not be obtained depending on mixing conditions.

Further, when small-size toners are used, surface area per gram is increased. Accordingly, a large amount of a fluidizing agent is used and mixing must be conducted so as to allow the fluidizing agent to firmly adhere to the toner to obtain fluidity.

Furthermore, when fine particles having a large particle size and fine particles having a small particle size are added to the toner, there are caused problems that the mixing of the particles having a large particle size is insufficient under conventional addition and mixing conditions for fine particles having a small particle size, a toner to which the external additives uniformly adhere can not be obtained and transferability is insufficient. FIG. II-1(B) is a sectional view of a toner where fine particles having a large particle size non-uniformly adhere to the toner, and the fine particles 2 having a large particle size concentratedly adhere to recessed areas (i.e., concave portions) on the surface of toner particle 1.

Accordingly, it has been demanded to improve developing properties, transferability (i.e., transferring property) and cleaning properties without causing the occurrence of toner cloud in development, namely, without causing a lowering in the charge quantity of the toner. The present invention has been accomplished to meet such requirements.

SUMMARY OF THE INVENTION

An object of the present invention is to provide a toner having a small-particle-size which has good toner adhesion as well as good developing properties, transferability and cleaning properties.

Another object of the present invention is to provide a toner for developing an electrostatic charge image, which uses a toner particle having a small-particle size which have high frictional chargeability and good fluidity and can form a good image without failure in transfer.

The present inventors have made studies under such consideration that the control technique of adhesion of practically charged toner, that is, not only the charge control of the toner but also the structural control of the toner are needed to essentially improve the problems associated with the prior art. We have examined the relationship between the constituent material and structure of the developer and the adhesion of the charged toner, and found that when fine particles having a particle size within a certain range are used as an external agent, the above-described objects can be achieved. The present invention has been accomplished on the basis of this finding.

Namely, the above-described objects of the present invention have been achieved by providing (1) a toner for developing an electrostatic charge image, which is formed by adding and mixing an external additive with toner particles having an average particle size of not larger than 9 μm and comprising at least a colorant and a binder resin, wherein said external additive is fine particles having a particle size of 20 to 80 nm, and (2) a process for preparing a toner for developing an electrostatic charge image, which comprises adding external additives to toner particles having an average particle size of not larger than 9 μm and comprising at least a colorant and a binder resin and mixing them, wherein fine particles (A) having a particle size of 20 to 80 nm as one component of the external additives are added to and mixed with the toner particles; and the addition and mixing of the fine particles (A) are carried out under such conditions that the product of an external addition shear rate $\gamma$ defined by formula (I) and the external addition mixing time Ta (sec) of the fine particles (A) satisfies the relationship defined by formula (II).

$$\gamma = V/D \quad \text{(I)}$$

wherein $\gamma$ represents an external addition shear rate, V represents a peripheral speed (m/sec) of the blade tip in a mixer, and D represents a clearance (m) between the blade tip and the inner wall of the mixer.

$$1\times10^5 \leqq \gamma \times Ta \leqq 1\times10^6 \quad \text{(II)}$$

wherein Ta represents the mixing time in seconds of the fine particles (A).

BRIEF DESCRIPTION OF THE DRAWINGS

FIG. I-1 is a graph illustrating the relationship between the charge quantity of toner particles and adhesion.

FIG. I-2 is a graph illustrating the relationship between the charge quantity of toner particles and a toner-peeling electric field.

Figure 1A:
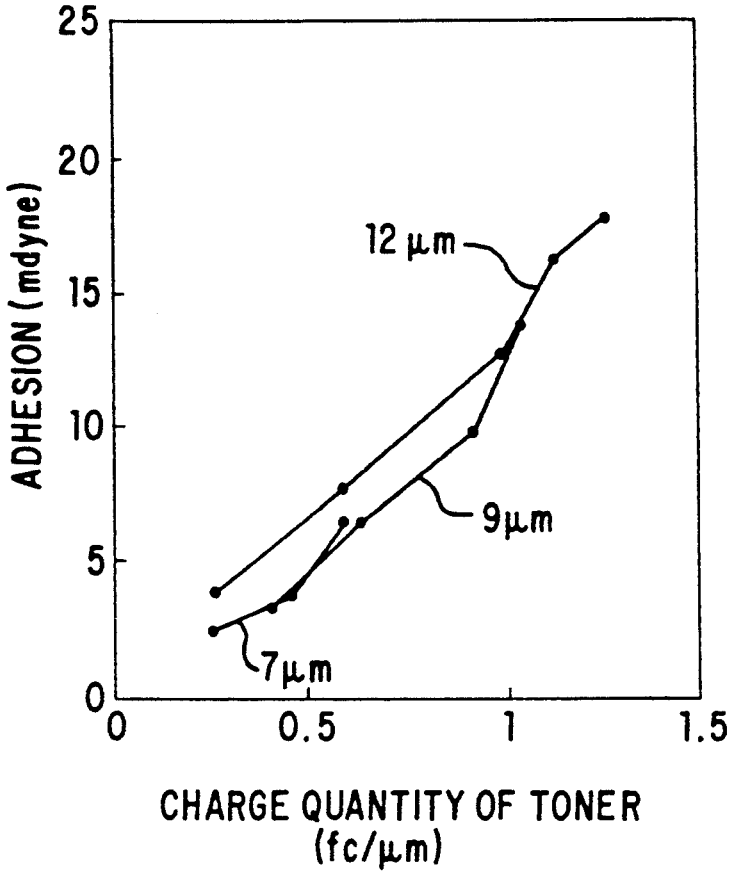
Figure 1B:
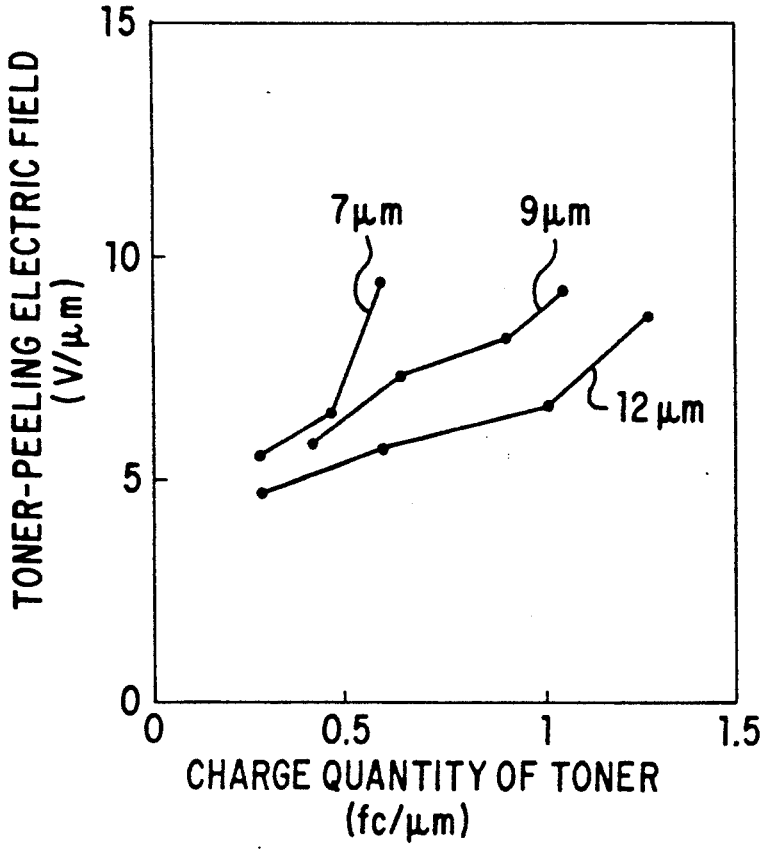
Figure 1C:
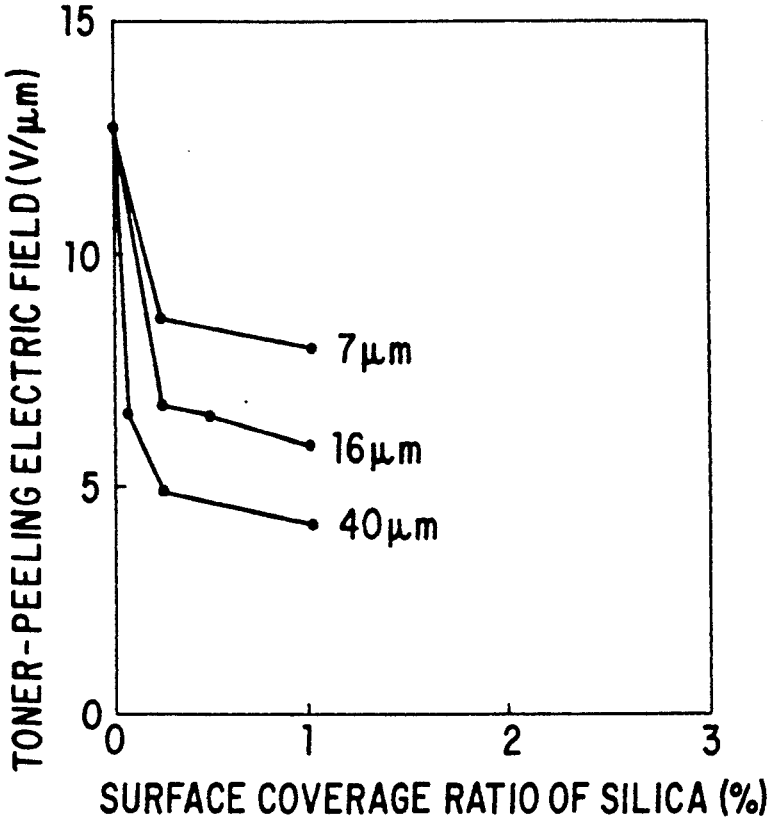
Figure 1D:
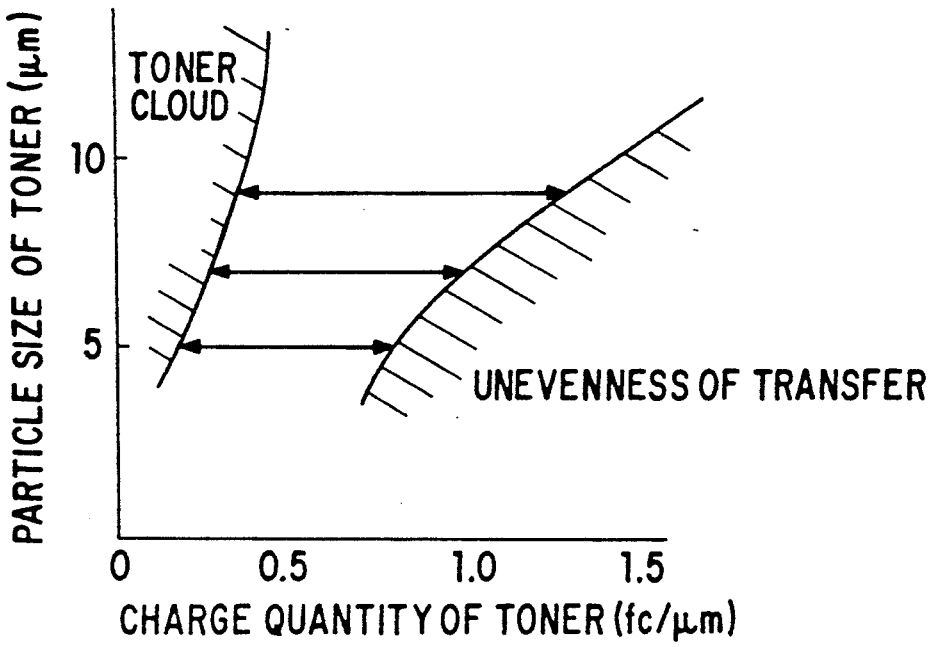
Figure 1E:
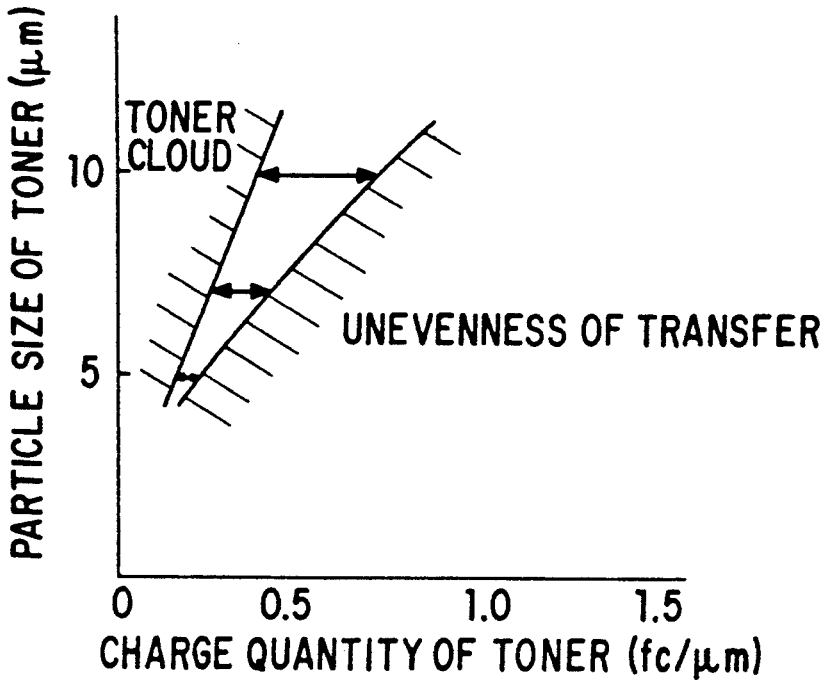
Figure 2A:
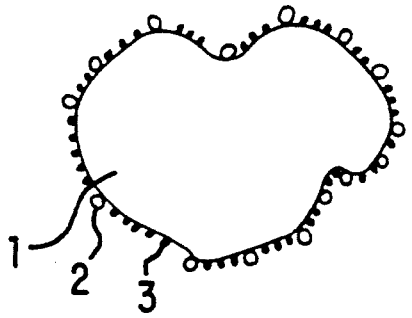
Figure 2B:
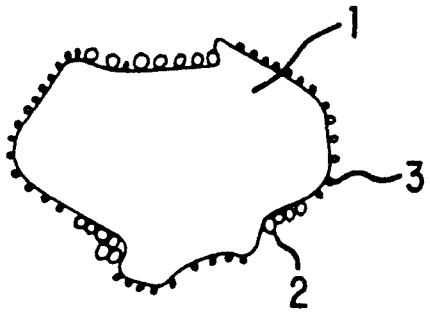
Figure 2C:
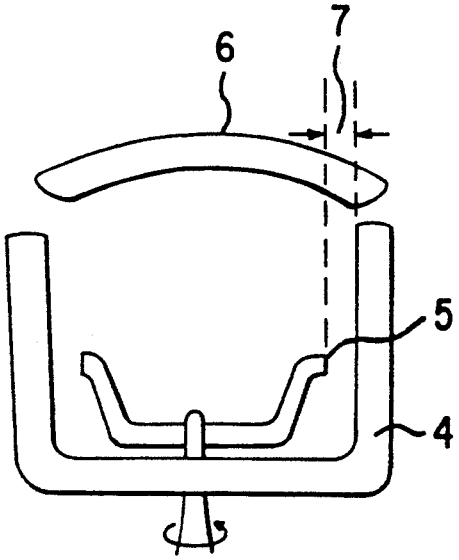

FIG. I-3 is a graph illustrating the relationship between the surface-coverage ratio of fine silica particles and a toner-peeling electric field.

FIG. I-4 is a graph illustrating latitude in the charge quantity of a toner to toner cloud and the evenness of transferred image in Example I-2.

FIG. I-5 is a graph illustrating latitude in the charge quantity of a toner to toner cloud and the evenness of transferred image in Comparative Example I-1.

FIG. II-1(A) is a sectional view of a toner according to the present invention. FIG. II-1(B) is a sectional view of conventional toner.

FIG. II-2 is a sectional view of a mixer used in the present invention.

DETAILED DESCRIPTION OF THE INVENTION

Now, the present invention will be illustrated in more detail below.

In the toner for developing an electrostatic charge image according to the present invention, which is formed by adding an external additive to toner particles having an average particle size of not larger than 9 μm and comprising at least a colorant and a binder resin and mixing them, it is preferred that the external additive is inorganic or organic spherical fine particles having a particle size of 20 to 80 nm. Further, it is preferred that the fine particles are externally added to the toner particles in such an amount that the surface-coverage ratio of the toner particles (the proportion of the surface of the toner particle covered with the fine particle of the external additive) reaches preferably at least 10% and more preferably 20 to 100%. If the surface-coverage ratio is more than 100%, the free external additive is increased, and thereby the secondary hindrance due to deposition of the external additive on the photoreceptor and carrier is generated.

Furthermore, in the electrophotographic developer of the present invention, the fine particles having a particle size of 20 to 80 nm are uniformly deposited on the surfaces of the toner particles comprising mainly a binder resin and a colorant. The measured value of coverage in a microphotograph taken by a scanning electron microscope (SEM) is used as the indication of the deposited state in the present invention. Namely, the surface of each toner particle in the SEM photograph is partitioned into several sections with each section being 9 $\mu m^2$. The coverage is determined by measuring the area of the fine particles in each section. It is preferred that the area occupied by the fine particle in each section, that is, the coverage value is at least 6% in each of all the sections in the present invention.

When the mean value of the coverages of the fine particles having a particle size of 20 to 80 nm as the external additive is lower than 6%, the fine particles are non-uniformly deposited on the surfaces of the toner particles and transferability becomes insufficient.

FIG. II-1(A) is a sectional view of the toner of the present invention wherein the fine particles are uniformly deposited on the surface of the toner particle 1. Numeral 2 represents large-particle-size fine particles, and 3 represents small-particle-size fine particles.

Any of inorganic fine particles and organic fine particles can be used as the fine particles of the external additive of the present invention. Examples of the inorganic fine particles include fine particles of tin oxide, fluorinated graphite, carbon black, silicon carbide, boron nitride, silica, aluminum oxide, titanium dioxide, zinc oxide, zirconium oxide, talc, titanium black, barium titanate, barium carbonate, lead titanate, gallium oxide, tantalum oxide, spinel, mullite, lanthanum oxide, cerium oxide, magnesium oxide, vanadium oxide, calcium carbonate, samarium oxide, terbium oxide, yttrium oxide, europium oxide, hematite, magnetite and various ferrites. Examples of the organic fine particles include acrylic ester resins, methacrylic ester resins, polyester resins, polystyrene resins and fluorine-containing resins. Among these, silica (particularly hydrophobic silica) is preferred. These resins may be used as a mixture thereof. Further, these fine particles may be surface-processed, for example, they may be surface-processed with a silane coupling agent, etc. The inorganic fine particles are preferable from the viewpoint of causing less change in shape. Spherical fine powders are particularly preferred.

In the present invention, the above-described inorganic or organic fine particles [hereinafter referred to as fine particles (A)] must have a particle size of within the range of 20 to 80 nm. The fine particles (A) have a particle size of preferably 20 to 60 nm, more preferably 30 to 60 nm, most preferably 30 to 50 nm. These fine particles function as a spacing agent. When the fine particles are added, a contact area between the toner and the carrier or between the toner and the photoreceptor is decreased and non-electrostatic adhesion (adhesive power) is reduced.

When the fine particles have a particle size of smaller than 20 nm, the fine particles are buried in the toner particles by friction due to the carrier or the blade and do not sufficiently function as the spacing agent, and a failure in the transfer of the toner occurs, while when the particle size is larger than 80 nm, a contact area with the main body of the toner particle becomes the same order, an effect of reducing the contact area due to the addition of the fine particles can not be sufficiently obtained, and a failure in the transfer of the toner occurs.

It is preferred that the fine particles are added to the toner particles in such an amount of as to give a surface-coverage ratio of preferably at least 10% and more preferably 20 to 100%. When the surface coverage ratio is lower than 10%, an effect of adding the fine particles can not be sufficiently displayed. The surface-coverage ratio is defined by the following formula.

$$f = \frac{\sqrt{3}}{2\pi} \cdot \frac{d_t P_t}{d_A P_A} \cdot C$$

wherein f represents the surface-coverage ratio, $d_t$ represents the particle size of the toner, $p_t$ represents the specific gravity of the toner, $d_A$ represents the particle size of the fine particle, $p_A$ represents the specific gravity of the toner, and C represents the ratio by weight of fine particle/toner.

It is preferred that the above-described fine particles (A) are used in combination with small-particle-size fine particles (B) such as silica having a particle size of preferably 5 to 20 nm, more preferably 7 to 18 nm and most preferably 10 to 16 nm in the present invention. When the fine particles (B) have a particle size of smaller than 5 nm, the adhesion of the fine particles to the toner particles is poor and the adhesion of the fine particles to the photoreceptor occurs, while when the particle size is larger than 20 nm, particles comprise only large-particle-size fine particles and there is a possibility that the fluidity of the toner is poor.

In the present invention, the fine particles (A) are added to the toner particles in such an amount on a weight basis as to give a surface-coverage ratio of preferably 10 to 40%, and more preferably 15 to 30%. The fine particles (B) are added to the toner particles in such an amount on a weight basis as to give a surface coverage ratio of preferably 30 to 80%, and more preferably 40 to 60%.

The toner particle of the present invention comprises at least a colorant and a binder resin. Conventional resins can be used as the binder resin. Examples of the binder resin include synthetic resins such as styrene resins, acrylic resins, olefin resins (e.g., polyethylene), diene resins (e.g , butadiene resins and isoprene resins), polyesters, epoxy resins, fluorine-containing resins, polyamides, silicone resins, phenolic resins, petroleum resins and polyurethanes; and natural resinous materials.

Any of conventional dyes and pigments can be used as the colorant. Examples of the colorant include carbon black, magnetite, nigrosine, Aniline Blue, Chrome Yellow, Ultramarine, Methylene Blue Chloride, Phthalocyanine Blue, Disazo Yellow and Rhodamine 6G Lake.

If desired, charge control agents may be added. There can be used any of conventional charge control agents which undergo pigment type dispersion or micelle-form dispersion (dispersion size being not larger than several milmicron) in the toner particles. Examples of the charge control agents include metal chelates such as metal-containing dyes, quaternary ammonium salts, various electron attractive/donative inorganic powders, inorganic materials surface-treated with a polar material and polar polymer beads.

In the present invention, the toner particles are formed so as to have an average particle size of not larger than 9 μm and preferably have an irregular shape. The above-described fine particles are added to and mixed with the toner particles to prepare a toner for developing an electrostatic charge image. Apparatuses which can be used for the preparation of the toner include Henschel mixer, Super mixer and UC mill.

FIG. II-2 is a schematic view showing an embodiment of a mixing apparatus which can be used in the present invention. In FIG. II-2, a rotary blade 5 is rotatably provided in a container 4, and a cover 6 is provided above the container. Numeral 7 represents the clearance between the blade tip and the inner wall of the container.

In the present invention, it is preferred that the addition and mixing of the external agent are carried out under such conditions that at least the addition and mixing of the fine particles (A) satisfy the relationship defined by the above-described formula (II). When the fine particles (A) and the fine particles (B) are added and mixed, the addition and mixing of these fine particles (A) and (B) are carried out under conditions defined by the above-described formula (II) and the following formula (III).

$$1 \times 10^5 \leqq \gamma \times Ta \leqq 1 \times 10^6 \quad \text{(II)}$$

$$1 \times 10^5 \leqq \gamma \times Tb \quad \text{(III)}$$

wherein γ represents an external shear rate (γ=V/D) as defined above, Ta represents the mixing time in seconds of fine particles (A), and Tb represents the mixing time in seconds of the fine particles (B).

In these cases, the peripheral speed V of the blade tip in the mixer is preferably in the range of 10 to 70 m/sec. The clearance D between the blade tip and the inner wall of the mixer is preferably in the range of 0.005 to 0.04 m. The mixing time of the fine particles (A) is preferably in the range of 1 to 30 minutes.

When the small-particle-size fine particles (B) are added in the present invention, it is preferred that the product of the external addition shear rate γ and the external addition mixing time Tb is at least $1\times10^5$. The product of $1\times10^6$ or more is more preferred because adhesion to the toner particles becomes more sufficient and impaction with the carrier is reduced. Further, the upper limit of the product, γ×Ta is preferably $1\times10^7$ because the product, γ×Ta is too large, the external additives are buried and thereby the good property due to the external additives cannot be obtained. That is, it is particularly preferred that the formula (III) is $$1\times10^5 \leqq \gamma\times Tb \leqq 1\times10^7$$

The present invention is now illustrated in greater detail with reference to Examples, but it should be understood that the present invention is not deemed to be limited thereto.

EXAMPLE I-1

| | |
|---|---|
| Styrene-n-butyl methacrylate (70:30) copolymer (Mn = 20,000, Mw = 35,000) | 100 parts by weight |
| Magenta pigment (C.I. Pigment Red 57:1) | 4 parts by weight |
| Potassium tetraphenylboron | 1 part by weight |

The above components were mixed, crushed and classified in a conventional manner to obtain toner particles having an average particle size of 9 μm.

Fine particles as external additives indicated in Table I-1 were added to and mixed with the resulting toner particles to obtain toner compositions.

Spherical ferrite having a particle size of 50 μm coated with a fluorine-containing resin and a styrene-acrylic copolymer was used as a carrier. The carrier was mixed with each of the above toner compositions in such an amount as to give a toner concentration of 8% by weight, to prepare each developer.

These developers were tested to evaluate the characteristics thereof.

(i) Measurement of adhesion for toner

A layer of the developer was formed on a magnetic roll and then bias-developed on an aluminum plate to form a toner layer. Control was made by mainly changing the bias of the number of times of development so that the weight of the toner layer become 1.0 mg/cm$^2$. Further, the toner concentration in the developer was changed to form a toner layer having different charge quantities. The resulting sample was opposed to an aluminum electrode by providing a gap of 400 μm. An external electric field was applied stepwise thereto to measure a toner-peeling electric field and the distribution of adhesion. The measurement was made under vacuum of about 10 mTr. The measurement results of adhesion are shown in Table I-1. Adhesion data in the charge quantity [(q/d)=1.0 fc/μm] of the toner are shown as representative value.

It can be seen from the results of Table I-1 that when the external additives having a particle size of about 40 nm are used, the adhesion (peeling electric field) of the charged toners can be effectively reduced. Further, it can be seen that when the surface coverage ratio is 10% or more, a sufficient effect of reducing adhesion (peeling electric field) can be obtained as shown in FIG. I-3.

(ii) Evaluation of transferability

The developers were charged into a copying machine ("FX6800 modified model", manufactured by Fuji Xerox Co., Ltd.) to evaluate transferability. The evaluation results are shown in Table I-1. The uniformity of solid image was evaluated in 5 grades. The uniformity of solid image corresponded nearly to adhesion. A toner having an external additive having a larger effect of reducing adhesion gave an excellent image quality.

EXAMPLE I-2

Toner particles having an average particle size of each of 5 μm, 7 μm and 9 μm were prepared by using the same composition as that of Example I-1. Fine silica particle having a particle size of 40 nm was added to and mixed with the toner particles in such an amount as to give a surface-coverage ratio of 50% to obtain toner compositions.

Each of the toner compositions was mixed with the ferrite carrier in the same manner as in Example I-1 to prepare developers.

In the same manner as in Example I-1, the developers were charged into the copying machine ("FX6800 modified model", manufactured by Fuji Xerox Co., Ltd.) to evaluate the uniformity of solid image. Good results were obtained in any of the toner particles having the abovedescribed average particle sizes. FIG. I-4 shows latitude in the charge quantity of the toner to toner cloud and the evenness of the transferred image. It is seen from FIG. I-4 that there is sufficient latitude even with the toner particles having a particle size of 5 μm.

COMPARATIVE EXAMPLE 1

Toner compositions were prepared in the same manner as in Example I-2 except that fine silica particles having a particle size of 16 nm as an external additive were added to the toner particles having an average particle size of each of 5 μm, 7 μm and 9 μm used in Example I-2. These toner compositions were evaluated in the same manner as in Example I-1. FIG. I-5 shows latitude in the charge quantity of the toner to toner cloud and the evenness of the transferred image. It can be seen from FIG. I-5 that the width of latitude is narrow as compared with that of Example I-2. It is seen that there is substantially no latitude with the toner particles having an average particle size of 5 μm and 7 μm in particular.

EXAMPLE I-3

| | |
|---|---|
| Polyester resin (Mn = 26,000, Mw = 80,000) | 100 parts by weight |
| Magenta pigment (C.I. Pigment Red 57:1) | 4 parts by weight |

The above components were mixed, crushed and classified in a conventional manner to obtain toner particles having an average particle size of 7 μm.

Fine silica particles having a particle size of 40 nm (surface-coverage ratio: 25%) and fine silica particles having a particle size of 7 nm (surface-coverage ratio: 50%) as a fluidizing agent were added to and mixed with the resulting toner particles to obtain a toner composition.

The toner composition was evaluated in the same manner as in Example I-1. A uniform transferred image was obtained.

COMPARATIVE EXAMPLE I-2

A toner composition was prepared in the same manner as in Example I-3 except that fine silica particles having a particle size of 40 nm as an external additive were added to the toner particles having an average particle size of 7 μm used in Example I-3. The resulting toner composition was evaluated in the same manner as in Example I-1. A relatively good image was obtained under normal environmental conditions, but unevenness in solid image was observed under low-temperature and low-humidity environmental conditions. When a running test was made, a failure in cleaning occurred after hundreds of copies were made.

COMPARATIVE EXAMPLE I-3

A toner composition was prepared in the same manner as in Example I-3 except that fine silver particles having a particle size of 40 nm (surface-coverage ratio: 5%) as an external additive and fine silica particles having a particle size of 7 nm (surface-coverage ratio: 50%) as a fluidizing agent were added to the toner particles having an average particle size of 7 μm used in Example I-3. The resulting toner composition was evaluated in the same manner as in Example I-3. As a result, unevenness in solid image was observed.

COMPARATIVE EXAMPLE I-4

A toner composition was prepared in the same manner as in Example I-2 except that fine silica particles having a particle size of 40 nm (surface-coverage ratio: 8%) was added to the toner particles used in Example I-2. The resulting toner compositions were evaluated in the same manner as in Example I-2. As a result, a relatively good image was obtained under normal environmental condition, but unevenness in solid image was observed under low-temperature and low-humidity environmental conditions, and further when a running test was made, a failure in cleaning occurred after hundreds of copies were made.

TABLE I-1

| Toner No. | External agent Type | Particle size (nm) | Surface coverage ratio (%) | Average adhesion*1 (mdyne) | Transfer characteristics*2 | Note |
|---|---|---|---|---|---|---|
| | — | — | — | 25 | 5 | Comp. Ex. |
| I-2 | $SiO_2$ | 7 | 10 | 21 | 5 | Comp. Ex. |
| I-3 | $SiO_2$ | 7 | 50 | 16 | 4 | Comp. Ex. |
| I-4 | $SiO_2$ | 7 | 100 | 15 | 4 | Comp. Ex. |
| I-5 | $SiO_2$ | 16 | 10 | 16 | 4 | Comp. Ex. |
| I-6 | $SiO_2$ | 16 | 50 | 12 | 3 | Comp. Ex. |
| I-7 | $SiO_2$ | 16 | 100 | 11.5 | 2 | Comp. Ex. |
| I-8 | $SiO_2$ | 40 | 10 | 12 | 2 | Invention |
| I-9 | $SiO_2$ | 40 | 50 | 8.5 | 1 | Invention |
| I-10 | $SiO_2$ | 40 | 100 | 8 | 1 | Invention |
| I-11 | $SiO_2$ | 100 | 50 | 13 | 4 | Comp. Ex. |
| I-12 | $TiO_2$ | 7 | 50 | 17 | 4 | Comp. Ex. |
| I-13 | $TiO_2$ | 40 | 25 | 8.5 | 1 | Invention |
| I-14 | polymethyl methacrylate | 40 | 100 | 15 | 3 | Invention |
| I-15 | polymethyl methacrylate | 300 | 30 | 29 | 5 | Comp. Ex. |

*1Value obtained when 50% of the toner was peeled off.
*2The uniformity of solid image was evaluated in the grade of 1 to 5. Grade 1: uniform, Grade 5: remarkably non-uniform

EXAMPLE II-1

| | |
|---|---|
| Polyester resin (a condensate of a bisphenol A ethylene oxide adduct with terephthalic acid, Mn = 3,000, Mw = 9,000) | 100 parts by weight |
| Magenta colorant (C.I. Pigment Red 57:1) | 4 parts by weight |

The above components were mixed, crushed and classified in a conventional manner to obtain toner particles having an average particle size of 7 μm.

Fine silica particle (A) having a particle size of 40 nm (surface-coverage ratio: 20%) and fine silica powder having a particle size of 7 nm (surface-coverage ratio: 40%) were mixed with the resulting toner particles, to obtain a toner composition. The mixing was conducted in a mixer equipped with a rotary blade ("Henschel mixer" manufactured by Mitsui Miike Kakoki KK) shown in FIG. II-2.

Cu-Zn ferrite (particle size: 50 μm) coated with a fluorine-containing resin and a styrene-acryl copolymer was used as a carrier. The above toner composition was mixed with the carrier in such an amount as to give a toner concentration of 8% by weight to prepare a developer.

The developer was tested to evaluate characteristics. Transferability was evaluated by copying a solid black image on a copying paper and measuring transparent portions (i.e., blank areas) in the resulting copy. After 25,000 copies were made, deposits on the surface of the photoreceptor were inspected, and a failure in the quality of the resulting image was checked. The results together with the mixing conditions are shown in Table II-1.

TABLE II-1

| Toner No. | Mixing conditions: Clearance (m) | Peripheral speed of blade tip (m/sec) | Shear rate (γ) ($sec^{-1}$) | Mixing time (Ta), (Tb) (sec) | γ × Ta, (γ × Tb ($\times 10^4$) | Defect in image quality due to adhere of external agent to the surface of photoreceptor | Transfer-ability | Overall evaluation |
|---|---|---|---|---|---|---|---|---|
| II-1 | 0.01 | 30 | $3 \times 10^3$ | 60 | 18 | M | G | M |
| II-2 | 0.01 | 30 | $3 \times 10^3$ | 300 | 90 | G | M | M |
| II-3 | 0.02 | 10 | $0.5 \times 10^3$ | 60 | 3 | B | G | B |
| II-4 | 0.02 | 10 | $0.5 \times 10^3$ | 300 | 15 | M | G | M |
| II-5 | 0.02 | 10 | $0.5 \times 10^3$ | 600 | 30 | G | G | G |
| II-6 | 0.02 | 10 | $0.5 \times 10^3$ | 900 | 45 | G | G | G |
| II-7 | 0.02 | 10 | $0.5 \times 10^3$ | 1200 | 60 | G | G | G |
| II-8 | 0.02 | 30 | $1.5 \times 10^3$ | 60 | 9 | B | G | B |
| II-9 | 0.02 | 30 | $1.5 \times 10^3$ | 300 | 45 | G | G | G |
| II-10 | 0.02 | 30 | $1.5 \times 10^3$ | 600 | 90 | G | M | M |
| II-11 | 0.02 | 30 | $1.5 \times 10^3$ | 900 | 135 | G | B | B |
| II-12 | 0.02 | 30 | $1.5 \times 10^3$ | 1200 | 180 | G | B | B |
| II-13 | 0.02 | 50 | $2.5 \times 10^3$ | 60 | 15 | M | G | M |
| II-14 | 0.02 | 50 | $2.5 \times 10^3$ | 300 | 75 | G | G | G |
| II-15 | 0.02 | 50 | $2.5 \times 10^3$ | 600 | 150 | G | B | B |

TABLE II-1-continued

| Toner No. | Mixing conditions: Clearance (m) | Peripheral speed of blade tip (m/sec) | Shear rate (γ) ($sec^{-1}$) | Mixing time (Ta), (Tb) (sec) | γ × Ta, (γ × Tb ($\times 10^4$) | Defect in image quality due to adhere of external agent to the surface of photoreceptor | Transfer-ability | Overall evaluation |
|---|---|---|---|---|---|---|---|---|
| II-16 | 0.02 | 50 | $2.5 \times 10^3$ | 900 | 225 | G | B | B |
| II-17 | 0.02 | 50 | $2.5 \times 10^3$ | 1200 | 300 | G | B | B |

G: No problem.
M: Slightly problem.
B: Bad (There is a problem.)

EXAMPLE II-2

The mixing of fine silica particle (A) having a particle size of 40 nm and fine silica particle (B) having a particle size of 7 nm was carried out by means of a two-stage mixing method in the preparation of the toner Nos. II-10, II-11, II-12, II-15, II-16 and II-17 in Example II-1. Namely, fine silica particle (B) was first added to the toner particles of Example II-1. After they were mixed under conditions indicated in Table II-2, the mixing was stopped, fine silica powder (A) was then added thereto, and the mixture was mixed under conditions indicated in Table II-2.

In the same manner as in Example II-1, developers were prepared by using the resulting toner compositions, and the evaluation of characteristics was made. The results are shown in Table II-2. It is seen from the results of Table II-2 that all of the toner Nos. II-18 to II-23 gave favorable results.

Further, the results which were obtained when the products, γ×Ta and γ×Tb were not within invention as shown in Table II-2 are shown in Table II-2 for comparing with the present invention.

-continued

| | |
|---|---|
| ethylene oxide adduct with terephthalic acid, Mn = 3,000, Mw = 9,000) | |
| Magenta colorant (C.I. Pigment Red 57:1) | 4 parts by weight |

The above components were mixed, crushed and classified in a conventional manner to obtain toner particles having an average particle size of 7 μm.

Fine silica particle having a particle size of 20 nm was mixed with the resulting toner particles, in such an amount as to give a surface coverage ratio of 60% to obtain a toner composition. The mixing ratio was conducted in a mixer equipped with a rotary blade ("Henschel mixer" manufactured by Mitsui Miike Kakoki KK) shown in FIG. II-2.

Cu-Zn ferrite (particle size: 50 μm) coated with a fluorine-coating resin and a styrene-acryl copolymer was used as a carrier. The above toner composition was mixed with the carrier in such an amount as to give a toner concentration of 8% by weight to prepare a developer.

TABLE II-2

| Toner No. | 1. Mixing method of toner particles with small-particle-size external additive: Clearance (m) | Peripheral speed (m/sec) | Shear rate ($sec^{-1}$) | Mixing time (sec) | γ × Tb | 2. Mixing method after addition of large-particle-size external additive: Clearance (m) | Peripheral speed (m/sec) | Shear rate ($sec^{-1}$) | Mixing time (sec) | γ × Ta | Characteristics: Defect in image quality | Transfer-ability | Overall evaluation |
|---|---|---|---|---|---|---|---|---|---|---|---|---|---|
| II-18 | 0.02 | 30 | $1.5 \times 10^3$ | 300 | $45 \times 10^4$ | 0.02 | 30 | $1.5 \times 10^3$ | 300 | $45 \times 10^4$ | G | G | G |
| II-19 | 0.02 | 30 | $1.5 \times 10^3$ | 600 | $90 \times 10^4$ | 0.02 | 30 | $1.5 \times 10^3$ | 300 | $45 \times 10^4$ | G | G | G |
| II-20 | 0.02 | 30 | $1.5 \times 10^3$ | 900 | $135 \times 10^4$ | 0.02 | 30 | $1.5 \times 10^3$ | 300 | $45 \times 10^4$ | G | G | G |
| II-21 | 0.02 | 50 | $2.5 \times 10^3$ | 300 | $75 \times 10^4$ | 0.02 | 50 | $2.5 \times 10^3$ | 300 | $75 \times 10^4$ | G | G | G |
| II-22 | 0.02 | 50 | $2.5 \times 10^3$ | 600 | $150 \times 10^4$ | 0.02 | 50 | $2.5 \times 10^3$ | 300 | $75 \times 10^4$ | G | G | G |
| II-23 | 0.02 | 50 | $2.5 \times 10^3$ | 900 | $225 \times 10^4$ | 0.02 | 50 | $2.5 \times 10^3$ | 300 | $75 \times 10^4$ | G | G | G |
| II-24 | 0.02 | 10 | $0.5 \times 10^3$ | 60 | $3 \times 10^4$ | 0.02 | 10 | $0.5 \times 10^3$ | 60 | $3 \times 10^4$ | B | B | B |
| II-25 | 0.02 | 30 | $1.5 \times 10^3$ | 600 | $90 \times 10^4$ | 0.02 | 30 | $1.0 \times 10^3$ | 1200 | $180 \times 10^4$ | G | B | B |

G: Good
B: Bad

EXAMPLE II-3

| | |
|---|---|
| Polyester resin (a condensate of a bisphenol A | 100 parts by weight |

The developer was tested to evaluate characteristics. The results together with the mixing condition are shown in Table II-3.

As is apparent from the results of Table II-3, all of the toner Nos. II-26 to II-28 gave favorable results.

TABLE II-3

| Toner No. | Mixing conditions: Clearance (m) | Peripheral speed of blade tip (m/sec) | Shear rate (γ) ($sec^{-1}$) | Mixing time (Ta) (sec) | γ × Ta ($\times 10^4$) | Defect in image quality due to adhere of external agent to the surface of photoreceptor | Transfer-ability | Overall evaluation |
|---|---|---|---|---|---|---|---|---|
| II-26 | 0.02 | 10 | $0.5 \times 10^3$ | 600 | 30 | G | G | G |
| II-27 | 0.02 | 10 | $0.5 \times 10^3$ | 900 | 45 | G | G | G |

TABLE II-3-continued

| Toner No. | Mixing conditions: Clearance (m) | Peripheral speed of blade tip (m/sec) | Shear rate ($\gamma$) ($sec^{-1}$) | Mixing time (Ta) (sec) | $\gamma \times Ta$ ($\times 10^4$) | Defect in image quality due to adhere of external agent to the surface of photoreceptor | Transfer-ability | Overall evaluation |
|---|---|---|---|---|---|---|---|---|
| II-28 | 0.02 | 10 | $0.5 \times 10^3$ | 1200 | 60 | G | G | G |

G: No problem,
M: Slightly problem,
B: Bad (There is a problem.)

The toners for developing an electrostatic charge image according to the present invention have improved development transfer properties without a lowering in the charge quantity of the toner, because the toners are formed by mixing fine particles having a particle size of 20 to 80 nm as an external additive with toner particles having a particle size of 9 μm or less. Further, the toners for developing an electrostatic charge image according to the present invention do not form toner cloud in development and exhibit good toner adhesion as well as good development transfer properties. Accordingly, an excellent image quality can be obtained. Furthermore, in the toners for developing an electrostatic charge image according to the present invention, an external additive is uniformly deposited on the surfaces of the toner particles. Thus, transferability is good, and a defect in image due to the adhesion of fine particles to the surface of the photoreceptor does not occur.

While the invention has been described in detail and with reference to specific examples thereof, it will be apparent to one skilled in the art that various changes and modifications can be made therein without departing from the spirit and scope thereof.

What is claimed is:

1. A process for preparing a toner for developing an electrostatic charge image, which comprises adding external additives to toner particles having an average particle size of not larger than 9 μm and comprising at least a colorant and a binder resin and mixing them, wherein fine particles (A) having a particle size of 30 to 80 nm as one component of the external additives are added to and mixed with the toner particles such that said fine particles adhere onto the surface of the toner particles; and the addition and mixing of said fine particles (A) are carried out under such conditions that the product of an external addition shear rate $\gamma$ defined by formula (I) and the external addition mixing time Ta (sec) of the fine particles (A) satisfies the relationship defined by formula (II);

$$\gamma = V/D \quad \text{(I)}$$

wherein $\gamma$ represents an external addition shear rate, V represents a peripheral speed (m/sec) of the blade tip in a mixer, and D represents a clearance (m) between the blade tip and the inner wall of the mixer;

$$1 \times 10^5 \leqq \gamma \times Ta \leqq 1 \times 10^6 \quad \text{(II)}$$

wherein Ta represents the mixing time (sec) of the fine particles (A).

2. The process for preparing a toner for developing an electrostatic charge image as claimed in claim 1, wherein fine particles (A) having a particle size of 30 to 80 nm and fine particles (B) having a particle size of 5 to 20 nm are added to and mixed with toner particles such that said fine particles (A) and (B) adhere onto the surface of the toner particles, the toner particles having an average particle size of not larger than 9 μm and comprising at least a colorant and a binder resin, and the addition and mixing of the fine particles are carried out under such conditions that the product of an external addition shear rate $\gamma$ defined by formula (I) and the external addition mixing time Ta (sec) of the fine particle (A) and the product of said external addition shear rate $\gamma$ and the external addition mixing time Tb (sec) of the fine particles (B) satisfy the relationship defined by formulas (II) and (III), respectively;

$$\gamma = V/D \quad \text{(I)}$$

wherein $\gamma$ represents an external shear rate, V represents the peripheral speed (m/sec) of the blade tip in a mixer, and D represents a clearance between the blade tip and the inner wall of the mixer;

$$1 \times 10^5 \leqq \gamma \times Ta \leqq 1 \times 10^6 \quad \text{(II)}$$

$$1 \times 10^5 \leqq \gamma \times Tb \quad \text{(III)}$$

wherein Ta represents the mixing time (sec) of the fine particles (A), and Tb represents the mixing time (sec) of the fine particles (B).

3. The toner as claimed in claim 1, wherein said toner particles are irregular shaped particles.

4. The process for preparing a toner as claimed in claim 1, wherein said toner particles are irregular shaped particles.

5. The process for preparing a toner as claimed in claim 2, wherein said toner particles are irregular shaped particles.

6. The toner as claimed in claim 4, wherein said fine particles as the external additive are spherical particles.

7. A toner for developing an eletrostatic charge image, comprising toner particles having at least a colorant and a binder resin, the toner particles having an average particle size of not larger than 9 μm, and inorganic fine particles having a particle size of 30 to 80 nm, the inorganic fine particles being mixed with the toner particles and adhered to the surface of the toner particles in an amount which gives a surface coverage ratio of at least 10% thereby improving toner transferring latitude between toner cloud and unevenness of transfer.

8. The toner as claimed in claim 7, wherein the coverage area of the fine particles on the surface of each toner particle is at least 6% per each section of 9 $\mu m^2$ in the photograph of a scanning electron microscope when the surface of one toner particle is partitioned into several sections.

9. The toner as claimed in claim 7, wherein the inorganic fine particles are silica particles.

10. A toner for developing an electrostatic charge, comprising toner particles having at least a colorant and a binder resin, the toner particles having an average particle size of not larger than 9 μm, first inorganic fine particles having a particle size of 5 to 20 nm adhered to the surface of the toner particles, and second inorganic fine particles having a particle size of 30 to 80 nm, the first and second inorganic fine particles being mixed with the toner particles and adhered to the surface of the toner particles in an amount which gives a surface coverage ratio of at least 10% thereby improving toner transferring latitude between toner cloud and unevenness of transfer.

11. The toner as claimed in claim 10, wherein both said first and second inorganic fine particles are silica particles.

* * * * *

UNITED STATES PATENT AND TRADEMARK OFFICE

CERTIFICATE OF CORRECTION

PATENT NO. : 5,296,324

DATED : March 22, 1994

INVENTOR(S) : Hideyuki AKAGI et al.

It is certified that error appears in the above-identified patent and that said Letters Patent is hereby corrected as shown below:

Column 1, line 29, change "I-1" to --1A--;
line 30, change "I-2" to --1B--; change "I-1" to --1A--;
line 32, change "I-2" to --1B--.
Column 2, line 17, change "II-1(B)" to --2B--.
Column 3, line 24, change "I-1" to --1A--;
line 27, change "I-2" to --1B--;
line 30, change "I-3" to --1C--;
line 33, change "I-4" to --1D--;
line 36, change "I-5" to --1E--;
line 39, change "II-1(A)" to --2A--;
line 40, change "II-1(B)" to --2B--;
line 42, change "II-2" to --2C--.
Column 4, line 19, change "II-1(A)" to --2A--.
Column 6, line 5, change "II-2" to --2C--;
line 7, change "II-2" to --2C--.
Column 7, line 39, change "I-3" to --1C--;
line 67, change "I-4" to --1D--.
Column 8, line 2, change "I-4" to --1D--;
line 13, change "I-5" to --1E--;
line 16, change "I-5" to --1E--.

UNITED STATES PATENT AND TRADEMARK OFFICE

CERTIFICATE OF CORRECTION

PATENT NO. : 5,296,324

DATED : March 22, 1994

INVENTOR(S) : Hideyuki AKAGI et al.

It is certified that error appears in the above-identified patent and that said Letters Patent is hereby corrected as shown below:

Column 10, line 11, change "II-2" to --2C--.

Column 12, line 30, change "II-2" to --2C--.

Signed and Sealed this

Sixteenth Day of August, 1994

*Attest:*

*Attesting Officer*

BRUCE LEHMAN

*Commissioner of Patents and Trademarks*